US005720444A

United States Patent [19]

Wheeler et al.

[11] Patent Number: 5,720,444

[45] **Date of Patent: *Feb. 24, 1998**

[54] STRIP ACCUMULATORS

[75] Inventors: Michael S. Wheeler, Chagrin Falls; Orst P. Kurylo, Norton, both of Ohio

[73] Assignee: Guild International Inc., Bedford, Ohio

[ * ] Notice: The term of this patent shall not extend beyond the expiration date of Pat. No. 5,601,250.

[21] Appl. No.: 778,288

[22] Filed: Jan. 2, 1997

Related U.S. Application Data

[63] Continuation-in-part of Ser. No. 590,788, Jan. 24, 1996, Pat. No. 5,601,250.

[51] Int. Cl.[6] ..... B65H 20/26

[52] U.S. Cl. ..... 242/364.1

[58] Field of Search ..... 242/364, 364.1, 242/364.2, 328, 328.1, 328.2

[56] References Cited

U.S. PATENT DOCUMENTS

| | | | |
|---|---|---|---|
| 3,258,212 | 6/1966 | La Tour | 242/364.1 |
| 3,782,662 | 1/1974 | Miller | 242/364.1 |
| 3,860,188 | 1/1975 | Bradshaw | 242/364.1 |
| 4,410,121 | 10/1983 | Wheeler et al. | 242/118 |
| 4,456,189 | 6/1984 | Wheeler et al. | 242/364.1 |
| 4,473,193 | 9/1984 | Cooper et al. | 242/364.1 |
| 4,529,140 | 7/1985 | Cooper et al. | 242/364.1 |
| 5,601,250 | 2/1997 | Wheeler et al. | 242/364.1 |

FOREIGN PATENT DOCUMENTS

| | | | |
|---|---|---|---|
| 2357144 | 5/1974 | Germany | 242/364.1 |

*Primary Examiner*—Michael Mansen

*Attorney, Agent, or Firm*—Renner, Otto, Boisselle & Sklar, P.L.L.

[57] ABSTRACT

A strip accumulator for supporting a continuous length of strip material includes a plurality of circumferentially spaced stationary idler rolls for supporting an inner bundle of convolutions of the strip material on edge and an outer rotatable table surrounding the stationary idler rolls for supporting an outer bundle of such strip convolutions on edge. The upper surfaces of the stationary idler rolls are at a height above the table support surface for ease of transfer of the convolutions of the inner bundle from the stationary idler rolls to the table as the convolutions of the inner bundle expand during filling of the accumulator with strip material. Also, the height difference between the upper surfaces of the stationary idler rolls and the support surface of the table is such that a lead-in of the strip material from the outer bundle to the inner bundle is sufficiently angled to cause the convolutions of the outer bundle to slide up onto the stationary idler rolls during both mill match operation when the rate of infeed of the strip material to the accumulator matches the rate of outfeed of the strip material from the accumulator and during a joining mode when movement of the incoming strip material is interrupted to permit a supply of strip material to be replenished externally of the accumulator while the strip material is still being withdrawn from the accumulator.

20 Claims, 5 Drawing Sheets

STRIP ACCUMULATORS

CROSS-REFERENCE TO RELATED APPLICATIONS

This application is a continuation-in-part of U.S. patent application Ser. No. 08/590,788, filed Jan. 24, 1996, now U.S. Pat. No. 5,601,250.

FIELD OF THE INVENTION

This invention relates to strip accumulators for storing a sufficient length of strip material received from a source of supply (e.g., a coil of strip material) to be able to feed the strip material to a mill, machine or other apparatus without interruption while the coil is being replenished/replaced.

BACKGROUND OF THE INVENTION

Strip accumulators of various types have long been used for storing a continuous length of strip material in an expanding and contracting spiral coil having a fixed number of turns with the strip material entering the outer diameter of the coil and withdrawn from the inner diameter or vice versa.

A major drawback of most accumulators is the time it takes to fill the accumulators to capacity after the supply of strip material has been replenished. The maximum fill speed of most accumulators is approximately 2.6 times the maximum line speed. This is particularly disadvantageous when processing thicker strip material with less footage in each coil or when processing smaller coils of any thickness of strip material in that the end of a new coil of strip material may be reached before the accumulators are filled to capacity, thus cutting down on the time available for the operator to replenish the supply by making coil changes and end welds without interruption or slowdown of the line.

SUMMARY OF THE INVENTION

With the foregoing in mind, it is a principal object of this invention to provide strip accumulators which are capable of overspeed filling of the accumulators with strip material, at speeds substantially in excess of 2.6 times the maximum line speed.

These and other objects of the present invention may be achieved by providing the accumulators with a plurality of circumferentially spaced stationary idler rolls for supporting an inner bundle of convolutions of strip material on edge and an outer rotatable table support surrounding the stationary idler rolls for supporting an outer bundle of such strip convolutions on edge, the convolutions of both bundles being one continuous length of strip material.

In one form of accumulator in accordance with the invention, lifters are provided to facilitate transfer of the convolutions from the inner bundle to the outer bundle. The lifters include lifter bars that are moved upward and radially outward during the fill mode to intersect the plane of the upper surfaces of the stationary idler rolls at a slight angle to gradually lift the convolutions from the inner bundle off the stationary idler rolls and deposit such convolutions onto the rotating table support during expansion of such convolutions.

When the lifters are in the upper or raised position, the radial outer ends of the lifters radially overlap the radial inner edge of the rotating table support. This may be accomplished by providing corresponding tapered surfaces on the underside of the radial outer ends of the lifters and upper side of the radial inner edge of the table support.

When the accumulator is filled to the desired capacity, the lifters are lowered out of the way so as not to interfere with the smooth transfer of the convolutions from the outer bundle to the inner bundle during both mill match operation of the accumulator when the rate of infeed of the strip material to the accumulator matches the rate of outfeed of the strip material from the accumulator and during the strip replenishing or welding mode when movement of the incoming strip material is stopped to permit the source of supply of strip material to be replenished exteriorly of the accumulator while strip material is still being withdrawn from the accumulator at line speed.

Relatively short rods or bars may be provided in the gap between the rotatable table support and the stationary idler rolls to prevent irregular or bent strip from getting hung up in the gap between the outer table support and stationary idler rolls during transfer of the strip material from the rotatable table support to the stationary idler rolls. Also, a plurality of relatively narrow radially extending skid bars or rods may be mounted in circumferentially spaced relation on the upper surface of the rotatable table support to reduce drag on the strip material during transfer of the strip material from the inner bundle to the outer bundle during overspeed filling of the accumulator.

In another form of accumulator in accordance with the invention, the stationary idler rolls are elevated such that the upper surfaces of the stationary idler rolls are at a height for example approximately one-half inch above the strip convolution support surface of the rotatable table support. Such raising of the stationary idler rolls allows the lifters to be eliminated, in that the elevated stationary idler rolls let the convolutions of the inner bundle slide freely across the gap between the stationary idler rolls and rotatable table support during transfer of the convolutions from the stationary idler rolls to the rotating table support as the convolutions of the inner bundle expand during overspeed filling of the accumulator with strip material without the need for lifters.

Moreover, the angle of the lead-in of the strip material from the lower rotatable table support to the higher stationary idler rolls facilitates sliding of the convolutions of the outer bundle from the rotatable table support onto the stationary idler rolls to provide for the smooth transfer of such convolutions from the outer bundle to the inner bundle during both mill match operation when the rate of infeed of the strip material to the accumulator matches the rate of outfeed of the strip material from the accumulator and during joining/welding mode when movement of the incoming strip material is interrupted to allow replenishment of the supply of strip material externally of the accumulator while the strip material is still being withdrawn from the accumulator at line speed.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but several of the various ways in which the principles of the invention may be employed.

DESCRIPTION OF THE PREFERRED EMBODIMENTS

Figure 1:
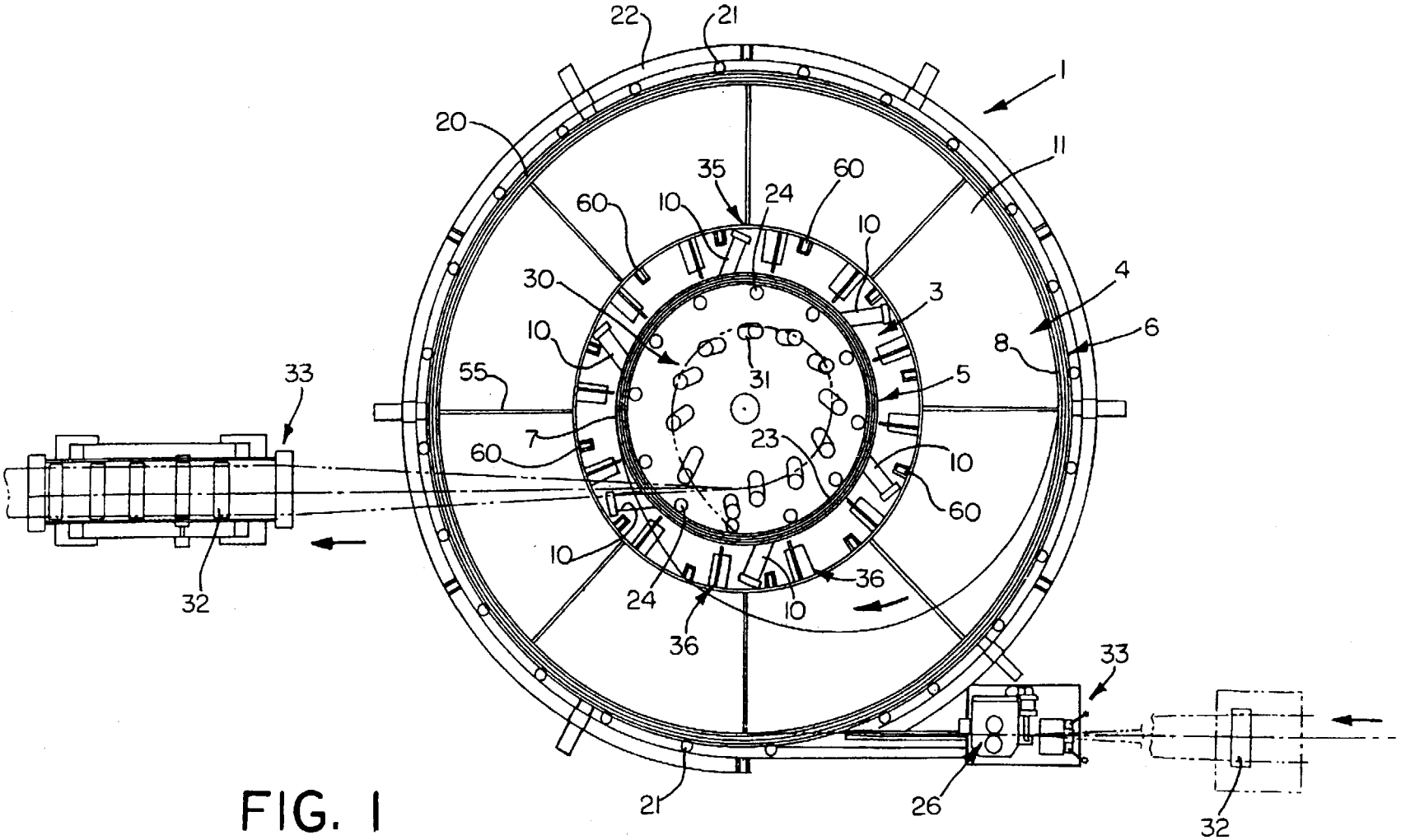
FIG. 1 is a schematic top plan view of one form of strip accumulator in accordance with this invention.
Figure 2:
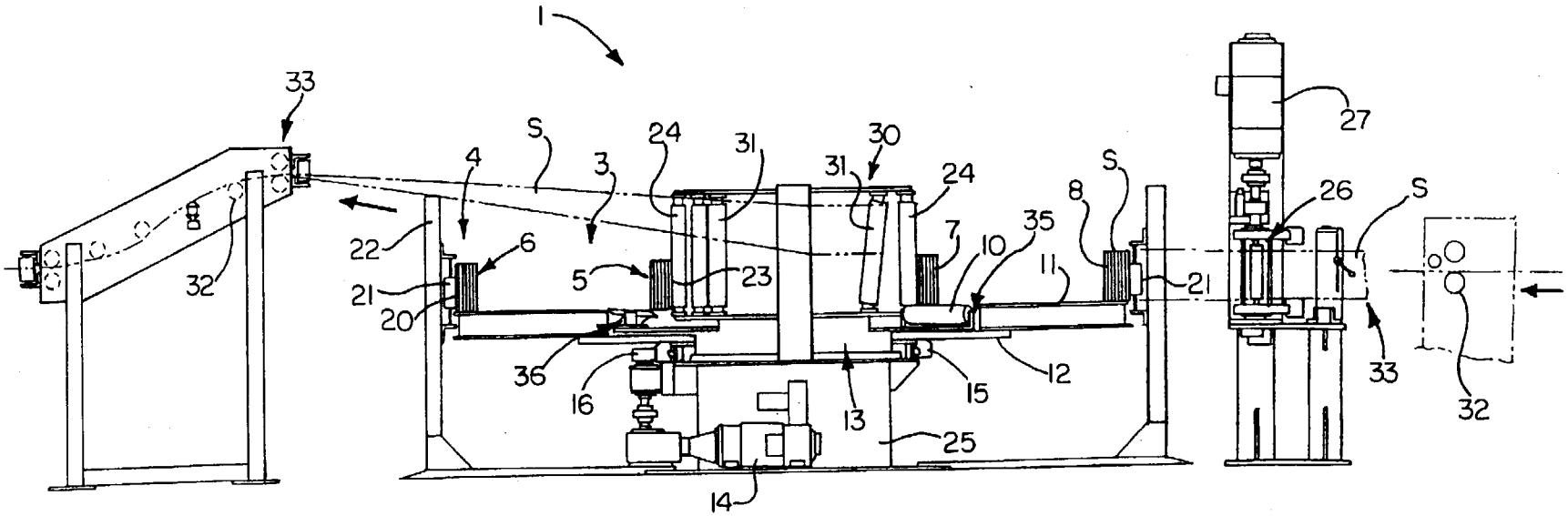
FIG. 2 is a schematic side elevation view, partly in section, of the accumulator of FIG. 1.

Referring now in detail to the drawings and initially to FIGS. 1 and 2, there is shown one form of strip accumulator 1 in accordance with this invention which is used to provide for the storage of a continuous length of strip material S, such as sheet metal strip, taken from a source of supply, such as a coil, and fed to a mill, machine or other apparatus. Excess strip material S is stored in the accumulator 1 so as to be available for use in providing a continuous supply of the strip material to the mill or other apparatus anytime there is an interruption in the source of supply, as when it is necessary to replenish the source of supply, so the mill or other apparatus can be kept running without interruption.

The accumulator 1 includes two radially spaced sections or regions 3, 4 for the storage of a continuous length spiral coil of strip material consisting of a plurality of continuous helically wound convolutions generally arranged in two radially spaced bundles 5, 6 of strip material on edge with the axes of the strip convolutions in each bundle being substantially vertical and the outer convolution 7 of the inner bundle 5 being connected to the inner convolution 8 of the outer bundle 6 and vice versa so that the strip material is continuous. The combined number of turns or convolutions of strip material in both bundles will of course vary depending on the size of the accumulator and the desired maximum amount of strip material to be stored in the accumulator. Since the diameters and thus the lengths of the convolutions within the outer section 4 are greater than those within the inner section 3, the transfer of the convolutions from the outer section 4 to the inner section 3 provides additional length of strip material permitting the continued withdrawal of the strip material from the accumulator during the strip replenishing mode when the source of supply of strip material is being replenished by welding or otherwise attaching the leading end of a new coil of strip material to the trailing end of a substantially spent coil as more fully described hereafter.

The convolutions which comprise the inner bundle 5 of strip material are supported on edge by a plurality of circumferentially spaced stationary idler rolls 10 which extend generally radially outward relative to the axial center of the accumulator 1. Preferably such idler rolls 10 extend at a slight angle, for example approximately twenty degrees, to the radius of the accumulator in the direction of strip flow through the accumulator as schematically shown in FIG. 1 to assist in the wrapping of the convolutions that are being transferred from the outer bundle 6 onto the inner bundle 5 during both mill match operation and when the source supply of strip material exteriorly of the accumulator is being replenished.

The convolutions which comprise the outer bundle 6 of strip material are supported on edge by a generally ring-shaped table 11 surrounding the stationary idler rolls 10. Table 11 is supported outwardly of the stationary idler rolls 10 from beneath by a support 12 that extends radially outward from a rotatably mounted central hub portion 13 beneath the idler rolls. The central hub portion 13 and thus the table 11 supported thereby are rotatably driven by a drive motor 14 through suitable gearing including a ring gear 15 on the outer diameter of the hub portion 13 engaged by a drive gear 16 suitably coupled to the drive motor.

The maximum diameter of the outermost turn 20 of the outer bundle 6 of convolutions supported by the rotatable table 11 may be determined by a circular array of rollers 21 mounted on the inner wall of a stationary outer containment ring 22 surrounding the rotatable table. The rollers 21 are vertically positioned on the containment ring 22 at a height to be contacted by the outermost turn 20 of the outer bundle when fully expanded as schematically shown in FIGS. 1 and 2.

The minimum diameter of the innermost turn 23 of the inner bundle 5 of convolutions is determined by a plurality of circumferentially spaced vertically extending inner containment rollers 24 suitably supported by the accumulator main frame 25 adjacent the radial inner periphery of the inner bundle.

The strip material S is fed into the accumulator 1 from a suitable external source of supply such as a coil of the strip material through an uncoiler or the like to the outer periphery of the outer bundle 6 of convolutions on the rotatable table 11 by a pair of entry pinch rolls 26 which are vertically aligned and radially spaced adjacent one another. One or both of the entry pinch rolls 26 are driven by a suitable drive motor 27 at a controlled speed for feeding the strip material into the accumulator.

The strip material S exits the accumulator from the innermost turn 23 of the inner bundle 5 of convolutions through a helical guide mechanism 30 located generally centrally of the accumulator. Such helical guide mechanism 30 includes a plurality of strip guide rolls 31 which together define a helical path for the outgoing strip material. The mill or other processing line which receives strip material from the accumulator may provide the power for withdrawing the strip material from the accumulator. Alternatively a separate drive (not shown) may be provided for driving exit pinch rolls during mill match operation if it was desired to have a supply of tension-free strip material for the mill.

Suitable guide rolls 32 are provided for supporting the strip material during its movement both from the external supply to the accumulator and from the accumulator to the strip processing line. Also, suitable turning mechanisms 33 may be provided for turning the strip material from the horizontal to the vertical before entering the accumulator and from the vertical to the horizontal after leaving the accumulator and before entering the processing line.

Because the table 11 which supports the outer bundle 6 of convolutions is mounted for rotation relative to the stationary idler rolls 10 which support the inner bundle 5, the rate at which the accumulator 1 can be filled to the desired capacity is much greater than would otherwise be possible. The fill rate is limited substantially only by the horsepower of the motors 14 and 27 used to drive the rotatable table 11 and entry pinch rolls 26. However, at the higher fill speeds (which may be substantially in excess of 2.6 times the maximum line speed), there is a substantial risk that the outer convolutions of the inner bundle 5 will expand too rapidly and get hung up in the gap 35 between the stationary idler rolls 10 and rotating table 11. To prevent that from happening, one or more lifter mechanisms 36 are mounted adjacent each of the stationary idler rolls 10 below such gap. In the embodiment disclosed in FIGS. 1 through 6, two such lifter mechanisms 36 are mounted adjacent opposite sides of each idler roll.

Figure 3:
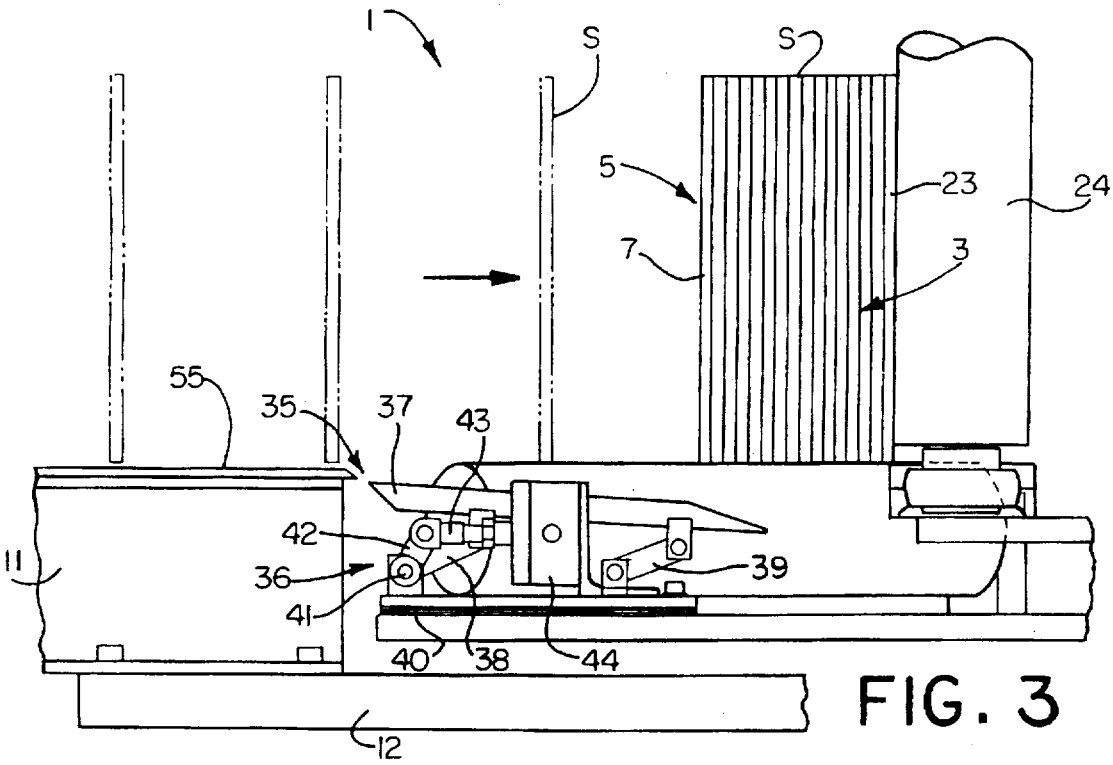
FIGS. 3 and 5 are enlarged fragmentary transverse sections through the accumulator of FIG. 1 showing one of the lifters in the gap between the outer rotatable table and inner stationary idler rolls, FIG. 5 illustrating one such lifter in the elevated position to facilitate transfer of the strip material from the inner bundle to the outer bundle during the overspeed fill mode, and FIG. 3 illustrating such lifter in the lowered position so as not to interfere with the transfer of strip material from the outer bundle to the inner bundle both during mill match operation of the accumulator and during the strip replenishing or welding mode when movement of the incoming strip material is stopped.
Figure 4:
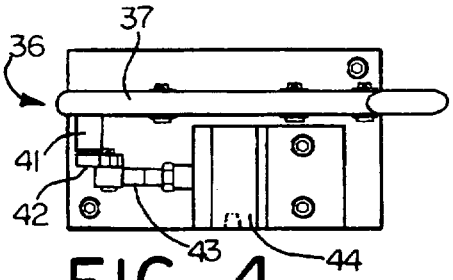
FIG. 4 is a top plan view of the lifter of FIG. 3.
Figure 5:
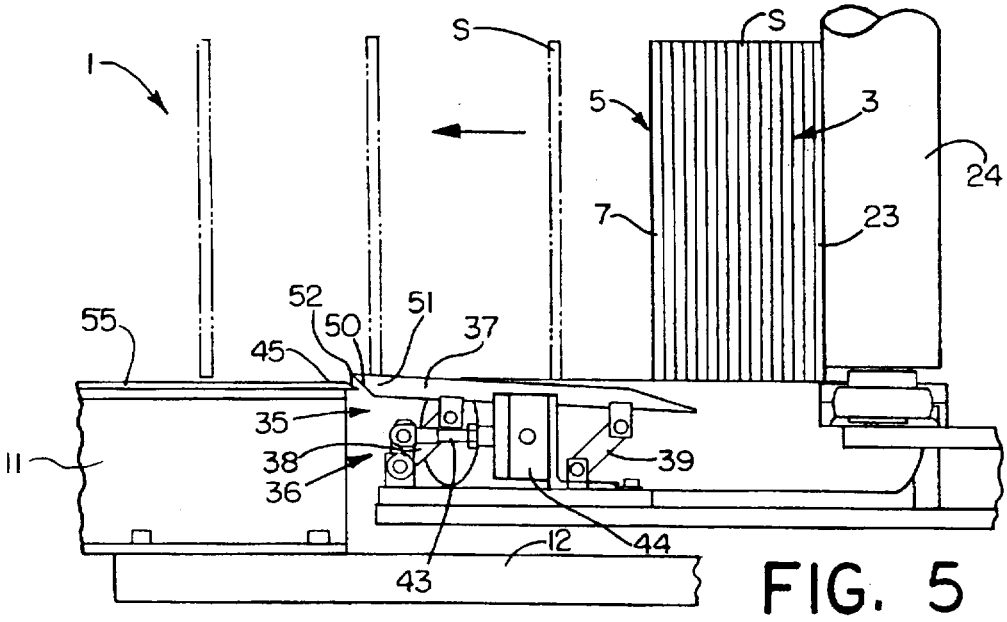

As best seen in FIGS. 3 through 5, each lifter mechanism 36 includes a lifter bar 37 supported by a pair of radially spaced apart rocker arms 38, 39 having opposite ends pivotally connected to a base portion 40 of the lifter mechanism and to the underside of the lifter bar, respectively. The lower end of one of the support arms (in this case the radially outermost arm 38) is keyed or otherwise secured to a rotatable shaft 41 to which the one end of a crank arm 42 is also fixedly connected. The other end of the crank arm 42 is pivotally connected to an axially movable output rod 43 of a suitable actuator 44.

As schematically shown in FIG. 3, when each actuator rod 43 is retracted, the lifter bars 37 are in a down position slightly below the plane of the upper surfaces of the rotatable table 11 and stationary idler rolls 10. However, when each of the actuator rods 43 is extended as schematically shown in FIG. 5, the lifter bars are raised upwardly and radially outwardly at a slight angle (i.e., approximately three and one-half degrees relative to the horizontal) so that the radial outer ends of the lifter bars intersect and extend slightly above the plane of the upper surfaces of the stationary idler rolls and rotatable table. Such angular orientation of the lifter bars when in the raised position may be obtained by making the radial inner rocker arms 39 somewhat shorter than the radial outer rocker arms 38.

When thus raised, the radial outer ends of the lifter bars 37 also desirably slightly radially overlap the radial inner edge 45 of the rotatable table 11 as by providing a radially outward and upward extending tapered surface 50 on the underside of the radial outer ends 51 of the lifter bars 37 and a correspondingly tapered upper surface 52 on the radial inner edge 45 of the table 11 (see FIG. 5). Accordingly, when the entry pinch rolls 26 and rotatable table 11 are synchronously driven with the table rotating in a clockwise direction as viewed in FIG. 1 at speeds in excess of 2.6 times the maximum line speed and the lifter bars are raised as schematically illustrated in FIG. 5, the convolutions of the inner bundle 5 of strip material will be expanded, causing such convolutions to move outwardly on the idler rolls 10 and slide up onto the lifter bars, one at a time, for depositing onto the rotating table 11 in a smooth and continuous manner.

If desired, a plurality of circumferentially spaced, radially extending skid bars or rods 55 may be mounted on the upper surface of the table 11 for supporting the outer bundle 6 to reduce the drag on the strip material during transfer of the convolutions from the inner bundle 5 to the outer bundle 6 during overspeed filling of the accumulator.

When the accumulator 1 is filled to the desired capacity, the actuator rods 43 are retracted to cause the lifter bars 37 to move to the down position shown in FIG. 3 where they will not interfere with the transfer of strip material S from the outer bundle 6 to the inner bundle 5. As long as there is an adequate external source of supply of the strip material, the rate of infeed of the strip material to the accumulator by the entry pinch rolls 26 and rate of rotation of the table 11 in the clockwise direction as viewed in FIG. 1 may be matched with the rate of outfeed of the strip material from the accumulator so that the mill or other strip processing line pulls the strip material out of the accumulator with little more tension than required for direct pulling of the strip material from an uncoiler. During such mill match operation, the strip material will be transferred from the outer bundle 6 to the inner bundle 5 at the same rate at which strip material is fed into the outer diameter of the outer bundle by the entry pinch rolls 26 and withdrawn from the inner diameter of the inner bundle 5 by the mill line.

When the external source of supply of strip material is substantially used up, an end detector or the like (not shown) signals the approaching trailing end of the incoming strip at which time the table 11 is stopped from rotating and the incoming strip material is stopped as by stopping the entry pinch rolls 26 so that the leading end of a new coil of strip material can be moved into position and welded or otherwise joined to the trailing end of the incoming strip material. During the strip replenishing or welding mode, the convolutions in the outer bundle 6 will be transferred one at a time, from the inside out, to the outer diameter of the inner bundle 5 to provide for the uninterrupted withdrawal of the stored length of strip material from the accumulator to the processing line.

Figure 6:
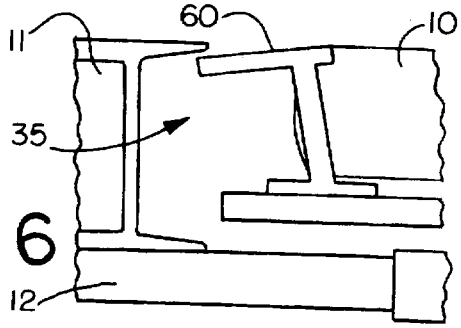
FIG. 6 is an enlarged fragmentary transverse section through the accumulator of FIG. 1 showing one of the fixed angled rods or bars positioned between the rotatable table support and stationary idler rolls to prevent irregular or bent strip material from getting hung up in such gap during transfer of the strip convolutions from the rotatable table support to the stationary idler rolls.

To prevent irregular or bent strip from getting hung up in the gap 35 between the table 11 and stationary idler rolls 10 during transfer of the strip convolutions from the outer bundle to the inner bundle, a plurality of relatively short radially extending rods or bars 60 may be mounted in circumferentially spaced relation within the gap 35 between the stationary idler rolls 10 and lifter mechanisms 36 (see FIG. 1 ). As schematically illustrated in FIG. 6, the rods 60 are desirably tucked under the radial inner edge of the table 11 a small amount and extend radially inwardly and upwardly at a slight angle, terminating substantially in the plane of the upper radial outer ends of the idler rolls 10.

Figure 7:
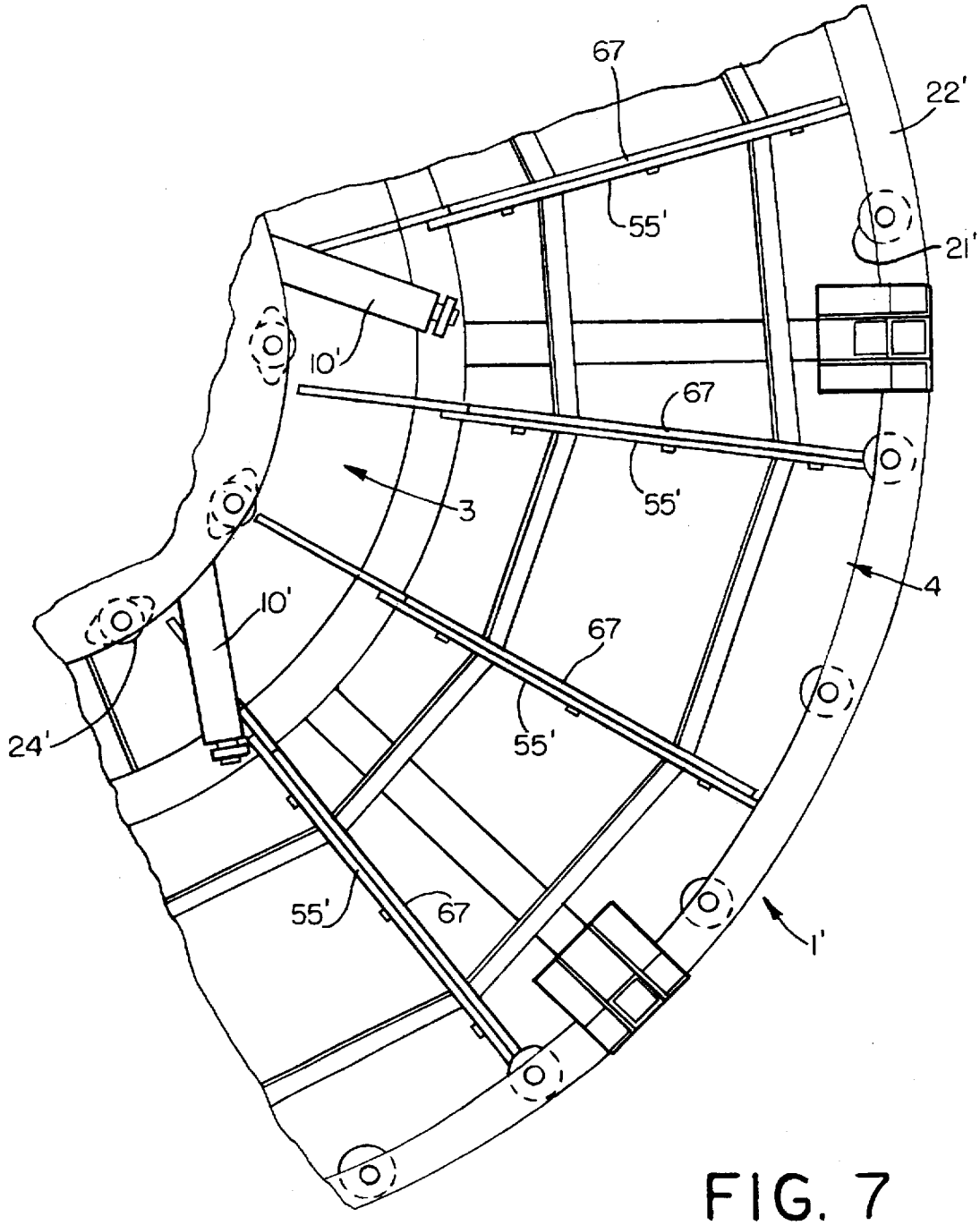
FIG. 7 is a fragmentary top plan view of another form of strip accumulator in accordance with this invention.
Figure 8:
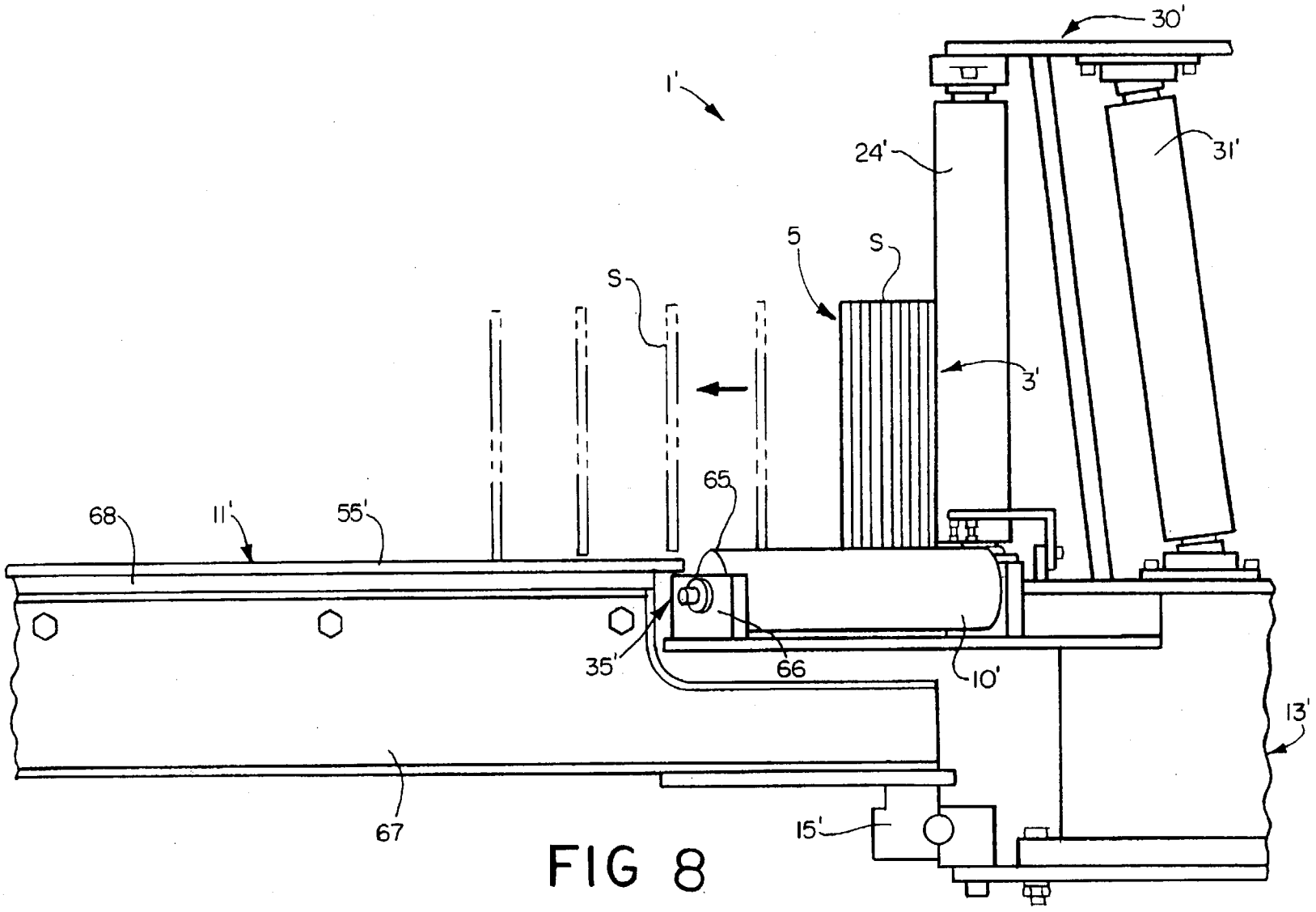
FIG. 8 is an enlarged fragmentary transverse section through the strip accumulator of FIG. 7 showing the upper surfaces of the stationary idler rolls elevated above the strip supporting surface of the rotatable table support.

In FIGS. 7 and 8 there is shown another form of strip accumulator 1' in accordance with this invention which is similar in many respects to the accumulator 1 previously described. Accordingly, the same reference numerals followed by a prime symbol are used to designate like parts. However, unlike the accumulator 1 previously described, the accumulator 1' does not include lifter mechanisms 36 to assist in providing for the smooth transfer of the convolutions of the inner bundle 5 of strip material S from the stationary idler rolls 10' to the rotating table support 11' during overspeed filling of the accumulator with strip material. Instead, such smooth transfer is obtained in the accumulator 1' by raising the stationary idler rolls 10' up such that the upper surfaces of the stationary idler rolls 10' which support the convolutions of the inner bundle 5 are at a height slightly above the convolution supporting surface 55' of the rotatable table support 11'. This allows the convolutions of the inner bundle 5 to slide across the gap 35' between the stationary idler rolls 10' and rotating table support 11' during transfer onto the rotatable table support as the convolutions of the inner bundle expand during overspeed filling of the accumulator with strip material.

In actual practice, it has been found that elevating the stationary idler rolls 10' such that the upper surfaces of the stationary idler rolls are at a height of approximately one-half inch above the convolution supporting surface 55' of the rotatable table support 11' will result in a smooth transfer of the convolutions of the inner bundle from the stationary idler rolls to the rotating table support during overspeed filling of the accumulator. However, it will be appreciated that this height difference could be varied within certain limits if desired.

Of course, the smaller the gap 35' between the stationary idler rolls 10' and rotatable table support 11', the less risk there is of the strip material S ever getting hung up in the gap during transfer of the strip convolutions from the inner stationary idler rolls to the outer rotating table support during overspeed filling of the accumulator with strip material.

In the accumulator 1' shown in FIGS. 7 and 8, the size of the gap 35' is reduced to a minimum by using as the convolution supporting surface 55' circumferentially spaced skid bars or rods 55' on the upper surface of the table support 11' which extend radially inwardly as close as possible to the radial outer ends 65 of the stationary idler rolls without contacting the stationary idler rolls during rotation of the table support around the stationary idler rolls. As best seen in FIG. 8, this is accomplished in accordance with the present invention by providing the outer shaft supports 66 for the stationary idler rolls 10' with a relatively low profile in order to permit the skid bars or rods 55' on the rotating table support 11' to extend radially inwardly above the outer shaft supports 66 and into close proximity to the outer ends of the stationary idler rolls.

The table support 11' shown in FIGS. 7 and 8 includes radial frame members or beams 67 that extend radially outwardly from the rotatably mounted central hub portion 13' of the accumulator beneath the stationary idler rolls 10'. A skid bar or rod 55' may be secured to each of these radial frame members 67 in any suitable manner, for example, by welding the bars or rods 55' to the tops of plates 68 bolted or otherwise secured to the sides of the radial frame members 67.

When the accumulator 1' is filled to the desired capacity, the lead-in of the strip material S from the lower rotatable table support 11' to the higher upper surfaces of the stationary idler rolls 10' is angled such that the convolutions of the outer bundle will slide up onto the stationary idler rolls 10' during transfer of the convolutions from the outer bundle to the inner bundle during both mill match operation when the rate of infeed of the strip material to the accumulator 1' matches the rate of outfeed of the strip material from the accumulator and during the welding mode when movement of the incoming strip material is interrupted to permit the supply of strip material to be replenished externally of the accumulator while the strip material is still being withdrawn from the accumulator at line speed.

From the foregoing, it will now be apparent that the strip accumulators of the present invention provide for the overspeed filling of the accumulator with strip material at speeds well in excess of 2.6 times the maximum processing line speed, with the filling speed being limited substantially only by the horsepower of the motors used to drive the rotary table and the entry pinch rolls.

Although the invention has been shown and described with respect to certain preferred embodiments, it is obvious that equivalent alterations and modifications will occur to others skilled in the art upon the reading and understanding of the specification. The present invention includes all such equivalent alterations and modifications and is limited only by the scope of the claims.

What is claimed is:

1. A strip accumulator for supporting a continuous length spiral coil of strip material consisting of a plurality of continuous helically wound convolutions having substantially vertical axes comprising a plurality of circumferentially spaced, generally radially extending stationary idler rolls for supporting an inner bundle of such convolutions on edge, a rotatable outer support surrounding said stationary idler rolls for supporting an outer bundle of such convolutions on edge, said stationary idler rolls and said outer support having an annular gap therebetween, and a drive mechanism for driving said outer support around said stationary idler rolls during filling of said accumulator with the strip material.

2. The accumulator of claim 1 wherein said outer support has a support surface for supporting the outer bundle of convolutions, and said stationary idler rolls have upper surfaces for supporting the inner bundle of convolutions, said upper surfaces of said stationary idler rolls being at a height above said support surface of said outer support to facilitate transfer of the convolutions of the inner bundle from said stationary idler rolls to said outer support as the convolutions of said inner bundle expand during filling of said accumulator with the strip material.

3. The accumulator of claim 2 wherein said upper surfaces of said stationary idler rolls are at a height of approximately one-half inch above said upper support surface of said outer support.

4. The accumulator of claim 2 wherein the height of said upper surfaces of said stationary idler rolls above said support surface of said outer support is such that a lead-in of the strip material from the outer bundle to the inner bundle is angled to cause the convolutions of the outer bundle to slide up onto said stationary idler rolls during both mill match operation when the rate of infeed of the strip material to the accumulator matches the rate of outfeed of the strip material from the accumulator and during a joining mode when movement of the incoming strip material is interrupted to permit a supply of strip material to be replenished exteriorly of the accumulator while the strip material is still being withdrawn from the accumulator.

5. The accumulator of claim 1 wherein said support surface on said outer support comprises a plurality of circumferentially spaced, radially extending rods on said outer support.

6. The accumulator of claim 1 further comprising a stationary outer containment member surrounding said rotatable outer support for determining the maximum diameter of the outermost convolution of the outer bundle.

7. The accumulator of claim 6 further comprising vertically oriented rollers on said outer containment member which are engageable by the outermost convolution of the outer bundle to reduce drag on the outer bundle during rotation of the outer bundle relative to said stationary outer containment member.

8. The accumulator of claim 1 further comprising a plurality of circumferentially spaced, vertically extending inner containment rollers positioned radially inwardly of the inner bundle of convolutions for determining the minimum diameter of the innermost convolution of the inner bundle.

9. The accumulator of claim 8 further comprising entry pinch rolls for feeding the strip material from an exterior source of supply of the strip material to the outer diameter of the outer bundle of convolutions, and a helical guide mechanism for guiding outgoing strip material from the inner diameter of the inner bundle of convolutions.

10. A strip accumulator for supporting a continuous length of strip material consisting of a plurality of convolutions having substantially vertical axes comprising a plurality of circumferentially spaced, generally radially extending stationary idler rolls for supporting an inner bundle of such convolutions on edge, a rotatable outer support surrounding said stationary idler rolls for supporting an outer bundle of such convolutions on edge, said stationary idler rolls and said outer support having an annular gap therebetween, and a drive mechanism for driving said outer support around said stationary idler rolls during filling of said accumulator with the strip material, said outer support having a support surface for supporting the outer bundle of convolutions, and said stationary idler rolls have upper surfaces for supporting the inner bundle of convolutions, said upper surfaces of said stationary idler rolls being at a height above said support surface of said outer support to facilitate transfer of the convolutions of the inner bundle from said stationary idler rolls to said outer support as the convolutions of said inner bundle expand during filling of said accumulator with the strip material.

11. The accumulator of claim 10 wherein said upper surfaces of said stationary idler rolls are at a height of approximately one-half inch above said support surface of said outer support.

12. The accumulator of claim 10 wherein the height of said upper surfaces of said stationary idler rolls above said support surface of said outer support is such that a lead-in of the strip material from the outer bundle to the inner bundle is angled to cause the convolutions of the outer bundle to slide up onto said stationary idler rolls during both mill match operation when the rate of infeed of the strip material to the accumulator matches the rate of outfeed of the strip material from the accumulator and during a joining mode when movement of the incoming strip material is interrupted to permit a supply of strip material to be replenished exteriorly of the accumulator while the strip material is still being withdrawn from the accumulator.

13. The accumulator of claim 10 wherein said support surface on said outer support comprises a plurality of circumferentially spaced, radially extending rods on said outer support.

14. The accumulator of claim 13 wherein said stationary idler rolls include radial outer shaft portions supported by outer shaft supports, and said rods have radial outer ends extending radially inwardly above said outer shaft supports into close proximity to said radial outer ends of said stationary idler rolls to minimize the gap between said stationary idler rolls and said outer support.

15. The accumulator of claim 14 wherein said outer support comprises a generally ring-shaped table surrounding said stationary idler rolls, said table including a plurality of circumferentially spaced frame members extending radially inwardly beneath said stationary idler rolls to a rotatably mounted center hub portion of said accumulator, said rods being attached to said frame members.

16. The accumulator of claim 15 wherein said rods are welded to plates bolted to sides of said frame members.

17. The accumulator of claim 10 wherein said stationary idler rolls extend at an angle to the radius of said accumulator in the direction of strip flow through said accumulator.

18. The accumulator of claim 10 further comprising a drive motor for rotating said outer support at speeds in excess of 2.6 times the speed of a processing line which receives strip material from said accumulator.

19. The accumulator of claim 18 further comprising entry pinch rolls for feeding strip material from an external source to an outer diameter of the outer bundle of convolutions at the same speed at which said outer support is rotated.

20. The accumulator of claim 19 further comprising a helical guide mechanism for guiding outgoing strip material from an inner diameter of the inner bundle of convolutions.

* * * * *